United States Patent [19]

Graham

[11] Patent Number: 4,775,150

[45] Date of Patent: Oct. 4, 1988

[54] SHOULDER MOTION RESTRAINT APPARATUS

[76] Inventor: Gary A. Graham, P.O. Box 77, Glacier, Wash. 98244

[21] Appl. No.: 117,993

[22] Filed: Nov. 9, 1987

[51] Int. Cl.[4] ..... A63B 23/00

[52] U.S. Cl. ..... 272/143; 272/144; 128/876

[58] Field of Search ..... 272/93, 134, 143, 144; 128/133, 134

[56] References Cited

U.S. PATENT DOCUMENTS

| | | | |
|---|---|---|---|
| 2,639,206 | 5/1953 | Butler | 128/134 |
| 3,271,028 | 9/1966 | Albin | 272/144 |
| 3,879,033 | 4/1975 | Martin | 272/144 |
| 4,316,608 | 2/1982 | Lundberg | 272/144 |
| 4,593,788 | 6/1986 | Miller | 128/134 |

*Primary Examiner*—Richard J. Apley
*Assistant Examiner*—J. Welsh
*Attorney, Agent, or Firm*—Robert W. Jenny

[57] ABSTRACT

The subject apparatus comprises straps which conform snugly to the user's shoulders to limit headward motion of the user in a direction essentially parallel to the user's spine and support structure with which the user's back is in contact. One end of each strap is attached to the support structure essentially at the point of tangency of the user's shoulder with the support structure. The other end of each strap is pivotally connected to one end of one of a pair of structural arms the other ends of which are pivotally connected to the support structure some distance in the headward direction from the points of attachment of the straps to the structure. When the apparatus is engaged by a user the straps wrap around the user's shoulders from back to front and the arms are at an acute angle to the support surface with one of their ends near the front portions of the user's shoulders and the other ends at their points of attachment to the support structure. With this configuration the apparatus conforms to a variety of sizes and shapes of shoulders without adjustment and use requires no buckling or unbuckling.

4 Claims, 2 Drawing Sheets

SHOULDER MOTION RESTRAINT APPARATUS

BACKGROUND OF THE INVENTION

Field

The subject concept is in the field of apparatus for limiting the motion of people and articles, particularly motion resulting from gravitational and inertial acceleration forces. More specifically it is in the field of apparatus for restraint of people on various supports such as seats, beds and exercise apparatus. Still more specifically it is in the field of apparatus for limiting shoulder motion of people in a direction essentially parallel to their spines and toward their heads. Still more specifically it is in the field of such apparatus which is quickly and easily engaged and disengaged with the user.

Prior Art

There is clearly very much prior art in the general field of this invention, patented and not patented, including the restraint apparatus used in airplanes, automobiles, baby carriages, bicycle seats and exercise apparatus. However, most of the prior apparatus involves buckles or similar fasteners and adjustment apparatus, the adjustment apparatus being required particularly when (1) the apparatus is to be used by people of various sizes and shapes and (2) the restraint must be firm, i.e. slack free. It has been found, in the use of exercise apparatus such as that disclosed in U.S. patent application Ser. No. 083,044, by the inventor of the subject apparatus, that the the buckling and adjustments required by conventional apparatus are inconvenient and can be hazardous in that users may not properly adjust the restraint apparatus because of the inconvenience. Therefore a need became apparent for restraint apparatus which limited motion of the user in the headward direction essentially parallel to the spine and which could accommodate a variety of users firmly and without adjustment or fastening.

The primary objective of the subject invention is to meet the described need. Further objectives are that the apparatus be reliable, economical and safe.

SUMMARY OF THE INVENTION

The apparatus is for use in conjunction with a support surface for the user, such as a seat back or a platform. In particular it is for use at the head end of a small platform called a shuttle used in an exercise apparatus in which the user lies supine on the shuttle and the shuttle is set into reciprocating motion essentially parallel to the user's spine. At each end of the reciprocating travel the shuttle is decelerated, stopped and re-accelerated in the opposite direction. As the shuttle is decelerated, the user must also be decelerated and this is accomplished, in the exercise apparatus being used for example, by the user's feet and legs at the foot end of the travel and by restraint apparatus at the head end of the travel. The restraint apparatus is attached to the shuttle near its head rest and engages the user's shoulders. The apparatus comprises two flexible, padded straps. One end of each strap is attached to the support surface, such as the surface of the shuttle, at a point just headward of the contact point of the headward end of the user's back with the support surface. In the in- use configuration the straps are wrapped over the shoulders and have lengths such that their other ends are positioned close to the user's chest and essentially even with the first, attached ends in the head-to-foot direction. These other ends are each pivotally attached at the ends of structural arms, one arm for each strap. The other ends of the arms are pivotally attached to the shuttle structure a distance headward from the shoulders of the user. When acceleration force tends to move the user's shoulders headward, the tendency is resisted by tension forces produced in the straps by shoulder contacts. The tension forces are transferred to the shuttle structure at one end of each strap and to the structural arms at the other ends. Since the structural arms are pivotally attached to the straps at one of their ends and the shuttle structure at the others, they are loaded as pin ended columns and therefore in compression only. Accordingly, the arms tend to wrap the straps over the shoulders in a stable structural situation and the forces between the shoulders and straps are uniformly distributed along the areas of contact of the shoulders on the straps. As a result, the straps automatically adjust to the conformation of the user and perform their function without requiring any buckling or unbuckling. This utility is enhanced by spring loading the structural arms so that, when the straps are not in use, the ends attached to the arms are lifted so that the straps are extended essentially linearly from their attachments to the shuttle to their attachments to the uplifted ends of the arms. For use, then, the user lies down on the shuttle and moves "into" the straps until they are snug on the user's shoulders. The utility is further enhanced by provision of adjustable or multi-position attachment of the structural arms to the shuttle. The invention is described in more detail below with reference to the attached drawings.

DETAILED DESCRIPTION OF THE INVENTION

Figure 1:
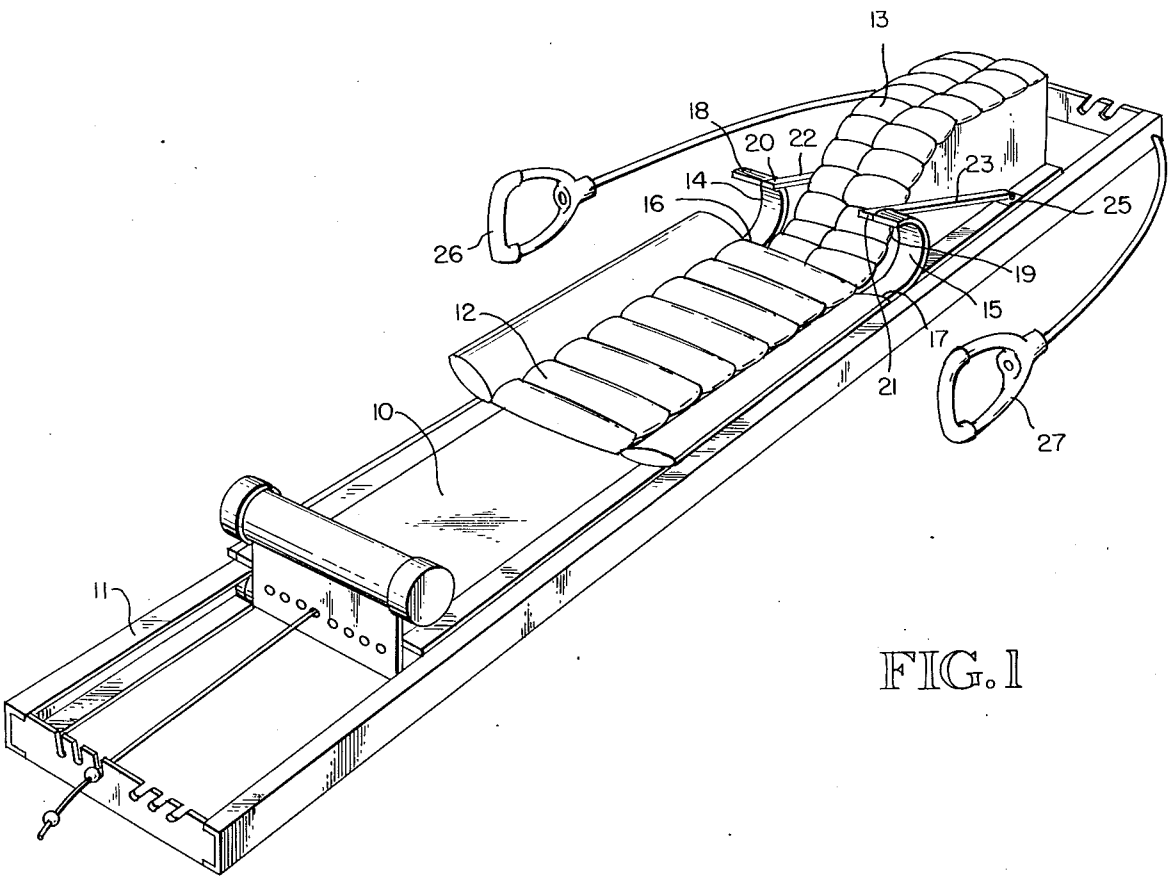
FIG. 1 is a perspective view of the subject apparatus installed on a particular exercise apparatus.
Figure 2:
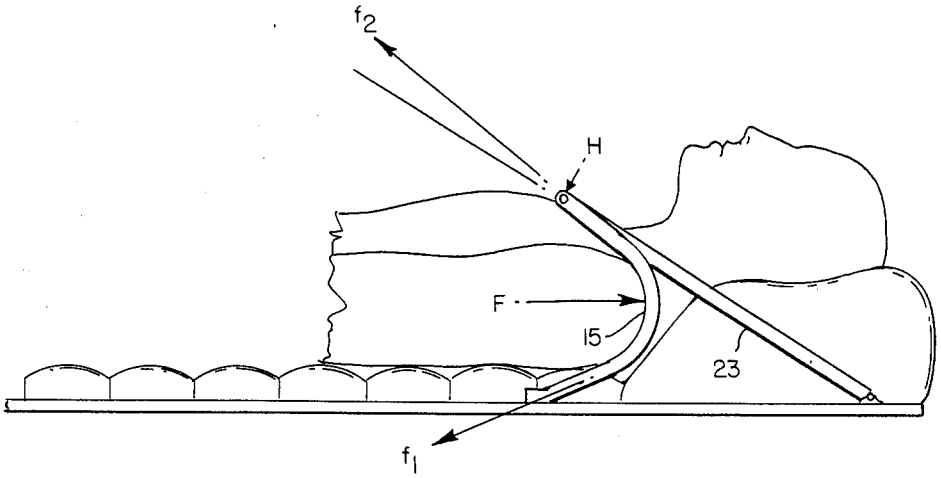
FIG. 2 is a side view of the exercise apparatus of FIG. 1 showing the subject apparatus engaging the shoulder of a user and including vector diagrams of forces involved.

FIG. 1 illustrates the subject invention installed on a particular exercise apparatus which comprises a shuttle 10 mounted on track assembly 11. The shuttle is free to move along the track assembly with spring systems tending to move it in the head-to-foot direction on the rails. In use the person using the apparatus lies back down on essentially planar pad 12 with his or her head on head rest 13 and shoulders engaged by straps 14 and 15. The straps are flexible and attached by one of their ends to the shuttle at points 16 and 17. The other ends 18 and 19 of the straps are attached to ends 20 and 21 of structural arms 22 and 23 by pivotal connections, the axes of the pivots being in the planes of the straps and perpendicular to their lengths. Ends 24 and 25 (end 24 not visible) are pivotally attached to the shuttle with the axes of these pivots essentially parallel to those at the other ends of the arms. All the pivotal connections have axes parallel to the essentially planar support surface and perpendicular to the direction of motion of the shuttle. To exercise, the user grasps handles 26 and 27 and accelerates the shuttle in the headward direction. The user then relaxes and the spring system (not shown) decelerates and stops the shuttle and accelerates it again in the head-to-foot direction. This procedure is repeated so that the shuttle and user are set into reciprocating motion on the rails. The user is decelerated, stopped and re-accelerated at the headward end of the motion by friction forces between the user and the shuttle surface and by force applied by the straps to the user's shoulders. For smooth cyclical applications of the force it is desired that the straps fit snugly around the user's shoulders and the apparatus as described automatically does so, as illustrated in FIG. 2, a side view of the apparatus with a person in place on the shuttle. The force of the person on the straps, strap 15 being shown in this view, is indicated by arrow F and resisted by tension forces in the straps reacted by forces $f_1$ and $f_2$ at the attachment points of the strap(s). Because the structural arms, arm 23 showing in this view, are pivotally attached at both ends, they function as pin ended columns and can carry only tension or compression loads, being loaded in compression in this case. With the tension force in the straps as indicated by arrow $f_2$ and the compression force in the arm as indicated by arrow $A_c$, acting in the directions indicated, there is a relatively smaller component of force as indicated by arrow H acting in the direction indicated to tend to hold the strap against the user's shoulder. If the end of the arm lifts or is lifted, the component of force indicated by arrow H will increase since the apparatus is structurally stable as shown. The weights of the arm(s) and part of the strap(s) adds to the force H to hold the strap(s) against the shoulder(s). Accordingly, the strap(s) fit snugly against the shoulders, are stably situated and resist any tendency of the person to move in a headward direction relative to the shuttle.

For the straps to function as described, angles between the lines of action of the arms and the surface of the support structure must be acute and small enough so that the points of attachment of the arms to the straps are well toward the fronts of the shoulders. Angles in the range of 10° to 40° are useful with the range of 25° to 35° preferred.

Figure 3:
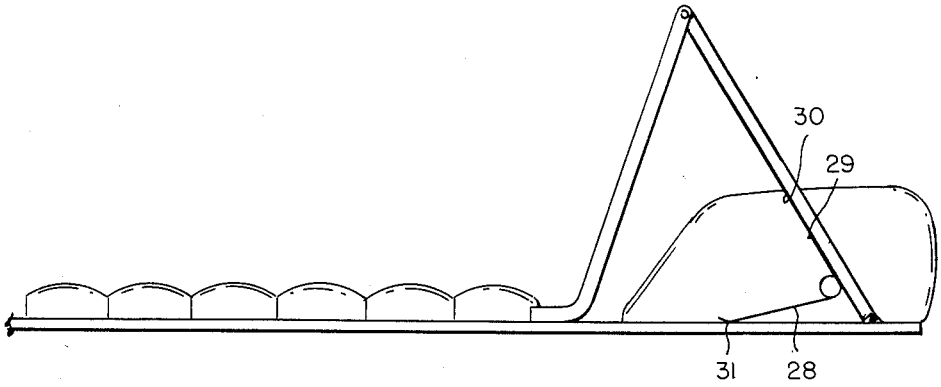
FIG. 3 is a side view of the exercise apparatus unoccupied and with spring support of the subject apparatus for simpler engagement by the user.

To simplify the use of the restraint apparatus springs may be added to provide torque about the pivotal connections of the arms to the shuttle to raise the arms to the configuration shown in FIG. 3 when they are not in use. The torques provided by the springs are made to be just enough to put the apparatus into the position shown and are readily overcome by the forces of gravity on the arms and straps in combination with the forces indicated by arrow H. Safety pin type spring 28 is one form of spring suitable for the described purpose. It is pivotally connected to the arm(s) at 29 and 30 and contacts the shuttle structure at 31.

The location of the attachment of the arms to the support structure may be adjustable in the direction indicated by arrow P in FIG. 3. This adjustability will accommodate differences in physical characteristics of users, allowing for variations in shoulder locations relative to the headrest.

It can be understood from this description that the subject invention meets its objectives. It prevents motion of a user in the headward direction relative to a surface on which the user is supported and accommodates a variety of users firmly without adjustments and fastening. The apparatus is also reliable, economical and safe. The reliability is enhanced because there are no fasteners to be neglected or misused or to fail. It is economical because of its simplicity. The safety is enhanced in the same manner as the reliability and also by the simplicity and inherent stability and ruggedness of the parts.

Also, it will be understood by those skilled in the art that while one embodiment of the invention is described herein, other embodiments and modifications of the one described are possible within the scope of the invention which is limited only by the attached claims.

What is claimed is:

1. Apparatus for limiting motion of a person in a first direction relative to essentially planar support structure, said person's back being in contact with said support structure, said first direction being headward and essentially parallel to said person's spine, said apparatus comprising:

a support structure with said person's shoulders adapted to contact said support structure at first and second points of tangency, a first flexible strap having a first end and a second end, a second flexible strap having a first end and a second end, a first structural arm having a first end and a second end and a first line of action, a second structural arm having a first end and a second end and a second line of action, said first end of said first strap being attached to said support structure near said first point of tangency, said first end of said second strap being attached to said support structure near said second point of tangency, said first end of said first structural arm being connected by a first pivotal connection to said support structure at a first point a first distance headward from said first point of tangency, said first end of said second structural arm being connected by a second pivotal connection to said support structure at a second point a second distance headward from said second point of tangency, said first and second distances being essentially equal, said second end of said first strap and said second end of said first structural arm being connected by a third pivotal connection, said second end of said second strap and said second end of said second structural arm being connected by a fourth pivotal connection, said first, second, third and fourth pivotal connections having axes essentially parallel to said support surface and perpendicular to said first direction, whereby with said shoulders in full engagement with said straps, said straps wrap around said shoulders and said first and second lines of action are at acute angles with said support surface, said angles being in the range of 10° to 40°.

2. The apparatus of claim 1 further comprising:

spring means at said first and second pivotal connections, said spring means tending to lift said third and fourth pivotal connections away from said structural support, thereby tending to increase said acute angles.

3. The apparatus of claim 1 in which said first and second distances are adjustable.

4. The apparatus of claim 2 in which said first and second distances are adjustable

* * * * *